US008179285B2

(12) United States Patent
Bamba

(10) Patent No.: US 8,179,285 B2
(45) Date of Patent: May 15, 2012

(54) MARINE VESSEL THEFT DETERRENT APPARATUS AND MARINE VESSEL INCLUDING THE SAME

(75) Inventor: Takaaki Bamba, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 422 days.

(21) Appl. No.: 12/538,887

(22) Filed: Aug. 11, 2009

(65) Prior Publication Data

US 2010/0045487 A1 Feb. 25, 2010

(30) Foreign Application Priority Data

Aug. 22, 2008 (JP) ..... 2008-214383

(51) Int. Cl.
*G06B 23/00* (2006.01)

(52) U.S. Cl. ..... 340/984; 304/425.5; 304/426.1

(58) Field of Classification Search ..... 340/984
See application file for complete search history.

(56) References Cited

U.S. PATENT DOCUMENTS

| | | | | |
|---|---|---|---|---|
| 6,404,071 | B1 * | 6/2002 | Kurano | 290/40 R |
| 6,525,643 | B1 * | 2/2003 | Okada et al. | 340/5.24 |
| 6,894,599 | B2 * | 5/2005 | Funayose et al. | 340/5.54 |
| 2006/0152348 | A1 * | 7/2006 | Ohtaki et al. | 340/426.1 |

FOREIGN PATENT DOCUMENTS

| | | |
|---|---|---|
| JP | 2001-146148 A | 5/2001 |
| JP | 2006-175999 A | 7/2006 |

OTHER PUBLICATIONS

Bamba; "Marine Vessel Theft Deterrent Apparatus and Marine Vessel Including the Same"; U.S. Appl. No. 12/538,886, filed Aug. 11, 2009.
Bamba; "Marine Vessel Theft Deterrent Apparatus and Marine Vessel Including the Same"; U.S. Appl. No. 12/538,888, filed Aug. 11, 2009.

* cited by examiner

*Primary Examiner* — George Bugg
*Assistant Examiner* — Kerri McNally
(74) *Attorney, Agent, or Firm* — Keating & Bennett, LLP

(57) ABSTRACT

A theft deterrent apparatus in a marine vessel having a propulsion device includes a key unit arranged to transmit a user authentication code, a first authentication unit disposed apart from the propulsion device, a second authentication unit, and an operation control unit disposed in the propulsion device. The first authentication unit is arranged to receive the user authentication code transmitted by the key unit, execute an authentication process on the user authentication code, and generate a unit authentication code. The second authentication unit is arranged to receive the unit authentication code generated by the first authentication unit and execute an authentication process on the unit authentication code. The operation control unit is arranged to allow operation of the propulsion device if authentication by the second authentication unit does succeed, and prohibit operation of the propulsion device if the authentication by the second authentication unit does not succeed.

8 Claims, 8 Drawing Sheets

MARINE VESSEL THEFT DETERRENT APPARATUS AND MARINE VESSEL INCLUDING THE SAME

BACKGROUND OF THE INVENTION

1. Field of the Invention

The present invention relates to a theft deterrent apparatus for a marine vessel which includes a propulsion device, and also to a marine vessel including such a theft deterrent apparatus.

2. Description of Related Art

An immobilizer is an example of an anti-theft apparatus for an automobile. The immobilizer collates an ID code, which is transmitted from a transponder incorporated in a key, with an ID code registered at the vehicle side. When these ID codes match, the immobilizer allows starting of an engine. The engine thus cannot be started unless a genuine key is used.

It has been proposed to apply such an immobilizer to a marine vessel to prevent the theft thereof (see, for example, Japanese Unexamined Patent Application Publication No. 2001-146148).

SUMMARY OF THE INVENTION

The inventor of preferred embodiments of the invention described and claimed in the present application conducted an extensive study and research regarding a marine vessel theft deterrent apparatus, and in doing so, discovered and first recognized new unique challenges and problems as described in greater detail below.

More specifically, in a case where an immobilizer is provided in an automobile, a plurality (for example, two) of key units, each incorporating a transponder that sends an authentication code, are handed over to a user. When one of these key units is lost, the user uses the single remaining key to start an engine and bring the automobile to a service center of a dealer, etc. A worker at the dealer, etc., then accesses the immobilizer using the single key unit held by the user and uses a specialized tool to register an authentication code of a new, separate key unit in the immobilizer. The user can thus possess a plurality of key units again and thereby to prepare for another incident of loss of a key unit.

However, with a marine vessel, circumstances differ from those of an automobile, and it is virtually impossible to bring the marine vessel to a service center of a dealer, etc. For example, in a case where an outboard motor is used as a propulsion device, incorporation of an immobilizer in the outboard motor may be considered. In this case, the outboard motor can be removed from the marine vessel, and it maybe considered that the outboard motor, which has been removed from the marine vessel, be brought to the service center of the dealer, etc. However in actuality, a large-scale machine, such as a crane, etc., is needed for movement of an outboard motor, and it is not realistic for a user to transport the outboard motor.

If the immobilizer and the propulsion device are disposed separately, just the immobilizer can be removed from the marine vessel and taken to the service center of the dealer, etc. However, with such a configuration, a theft deterrent effect is diminished because starting of the propulsion device is made possible by detaching the immobilizer from the propulsion system.

It is thus difficult to realize a marine vessel theft deterrent apparatus with which maintenance of an authentication unit is easy and yet an adequate theft deterrent effect can be maintained as well.

In order to overcome the previously unrecognized and unsolved problems mentioned above, a preferred embodiment of the present invention provides a marine vessel theft deterrent apparatus for a marine vessel which includes a propulsion device. The theft deterrent apparatus includes a key unit arranged to transmit a user authentication code, a first authentication unit disposed apart from the propulsion device, a second authentication unit, and an operation control unit disposed in the propulsion device. The first authentication unit is arranged to receive the user authentication code transmitted by the key unit, execute an authentication process (user authentication process) on the user authentication code, and generate a unit authentication code. The second authentication unit is arranged to receive the unit authentication code generated by the first authentication unit and execute an authentication process (unit authentication process) on the unit authentication code. The operation control unit is arranged to allow operation of the propulsion device if authentication by the second authentication unit does succeed, and prohibit operation of the propulsion device if the authentication by the second authentication unit does not succeed.

With this configuration, the user authentication code transmitted by the key unit is subject to the authentication process in the first authentication unit, which is disposed apart from the propulsion device. The first authentication unit generates the unit authentication code. The unit authentication code is subject to the authentication process by the second authentication unit. If the authentication by the second authentication unit does not succeed, the operation control unit prohibits operation of the propulsion device. The operation of the propulsion device thus cannot be started without the key unit that transmits the legitimate user authentication code. A theft deterrent effect is thus provided.

The first authentication unit is disposed apart from the propulsion device and maintenance thereof can thus be performed by separating it from the system. For example, collation source data of a user authentication code of another, new key unit can be registered in the first authentication unit.

When the first authentication unit is separated from the system, the authentication process of the unit authentication code generated by the first authentication unit fails. The operation control unit thus prohibits operation of the propulsion device. Thus, even if the first authentication unit is removed, the operation of the propulsion device cannot be started. Theft by removal of the first authentication unit is thus counteracted and a high theft deterrent effect is thus provided.

The operation control unit may accept the authentication result of the first authentication unit if authentication by the second authentication unit does succeed, allow operation of the propulsion device if authentication by the first authentication unit does succeed, and prohibit operation of the propulsion device if the authentication by the first authentication unit or the second authentication unit does not succeed. That is, the operation control unit may control the prohibition of operation and allowing of operation of the propulsion device in consideration not only of the authentication result of the second authentication unit but of the authentication result of the first authentication unit as well.

In a preferred embodiment of the present invention, the second authentication unit is disposed in the propulsion device. With this configuration, the second authentication unit does not have to be disposed separately because the second authentication unit is disposed in the propulsion unit. For example, a function of the second authentication unit may be carried out by a software process by a computer disposed in the propulsion device.

A marine vessel theft deterrent apparatus according to a preferred embodiment of the present invention further includes an operational unit, connected to the propulsion device and being arranged to be operated by a user to operate the propulsion device. The operational unit may include the second authentication unit and generates an operational unit authentication code. It is preferred in this case that the marine vessel theft deterrent apparatus may further include a third authentication unit which is disposed in the propulsion device and arranged to execute an authentication process on the operational unit authentication code generated by the operational unit. Preferably, the operation control unit is arranged to allow operation of the propulsion device if authentication by the third authentication unit does succeed and prohibit operation of the propulsion device if the authentication by the third authentication unit does not succeed.

With this configuration, the second authentication unit is disposed in the operational unit, and the third authentication unit for the operational unit authentication code generated by the operational unit is disposed in the propulsion device. Starting of the propulsion device is thus allowed only in a case where the authentication of the user authentication code succeeds, the authentication of the unit authentication code succeeds, and the authentication of the operational unit authentication code succeeds. The allowing of starting and the prohibition of starting of the propulsion device can thus be controlled according to the user authentication by utilizing the configuration for authentication of the operational unit.

The function of the second authentication unit may be realized by a software process by a computer disposed in the operational unit. Likewise, the function of the third authentication unit may be realized by a software process by a computer disposed in the propulsion device.

The operation control unit may accept the authentication result of the first authentication unit if authentications by the second and third authentication units do succeed, allow operation of the propulsion device if authentication by the first authentication unit does succeed, and prohibit operation of the propulsion device if the authentication by the first authentication unit does not succeed. That is, the operation control unit may accept the authentication result of the first authentication unit and control the prohibition of operation and allowing of operation of the propulsion device in consideration of the authentication result.

A preferred embodiment of the present invention provides a marine vessel that includes a hull, a propulsion device installed on the hull, and the marine vessel theft deterrent apparatus having the above-described characteristics. With this configuration, an excellent theft deterrent effect is provided without degradation of maintainability of the authentication unit for the user authentication code.

Other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
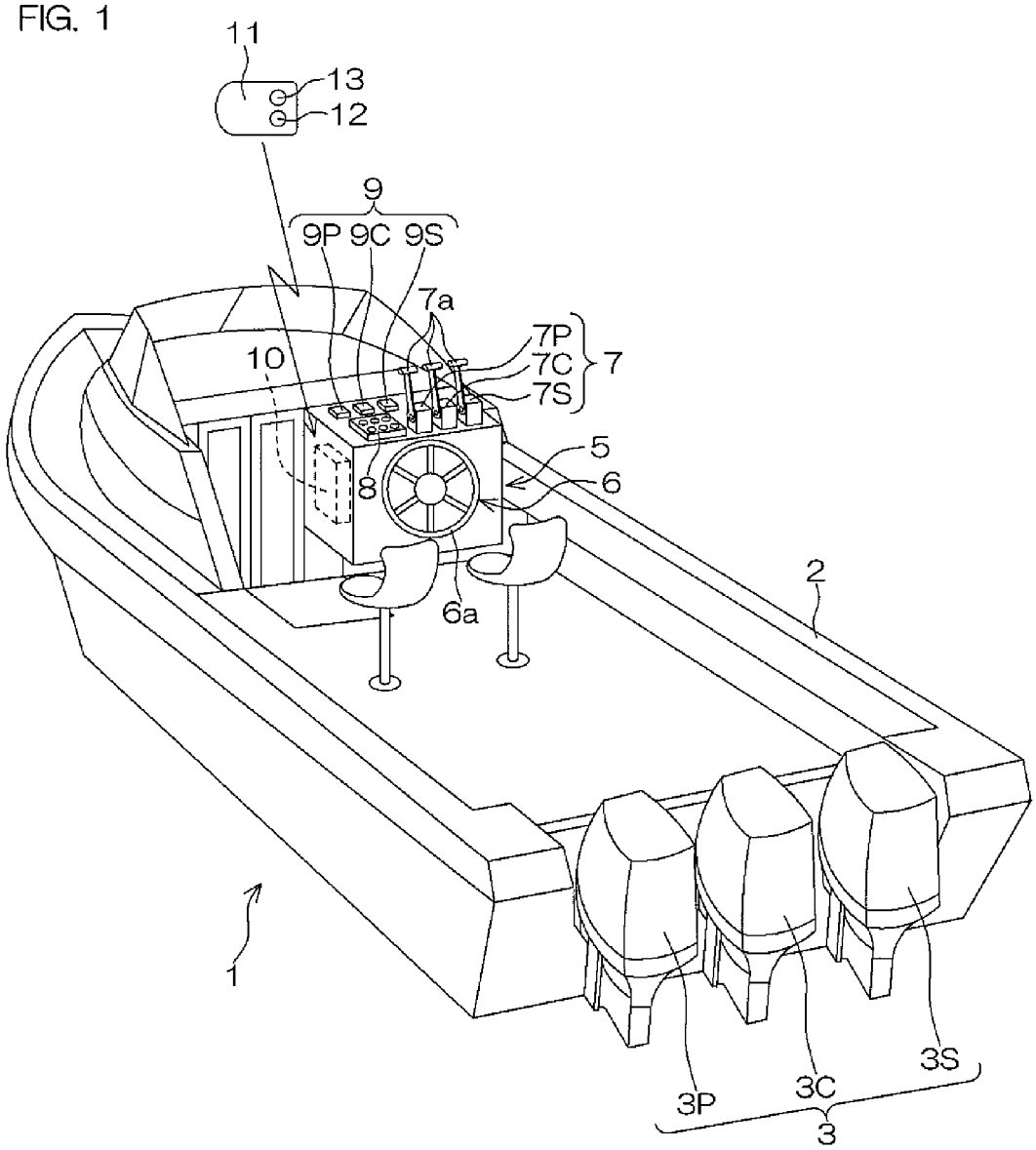
FIG. 1 is a perspective view for explaining a configuration of a marine vessel according to a preferred embodiment of the present invention.

FIG. 1 is a perspective view for explaining a configuration of a marine vessel according to a preferred embodiment of the present invention. The marine vessel 1 includes a hull 2 and outboard motors 3 as propulsion devices. A plurality of the outboard motors 3 (for example, three motors in the present preferred embodiment) are provided. These outboard motors 3 are attached in parallel to a stern of the hull 2. When each of the three outboard motors is to be distinguished, that disposed at a starboard side shall be referred to as the "starboard side outboard motor 3S," that disposed at a center shall be referred to as the "central outboard motor 3C" and that disposed at a portside shall be referred to as the "portside outboard motor 3P." Each of the outboard motors 3 includes an engine and generates a propulsive force by means of a screw that is rotated by a driving force of the engine.

A marine vessel maneuvering compartment 5 is disposed at a front portion (stem side) of the hull 2. The marine vessel maneuvering compartment 5 includes a handle apparatus 6, remote controllers 7, an operational panel 8, and gauges 9.

The handle apparatus 6 includes a steering handle 6a that is rotatingly operated by an operator. The operation of the steering handle 6*a* is mechanically transmitted by a cable (not shown) to a steering mechanism (not shown) disposed at the stern. The steering mechanism changes the directions of the three outboard motors 3 in a coupled manner. The directions of the propulsive forces are thereby changed and a heading direction of the marine vessel 1 can be changed accordingly.

Three remote controllers 7 are provided in correspondence to the three outboard motors 3. When these are to be distinguished, that corresponding to the starboard side outboard motor 3S shall be referred to as the "starboard side remote controller 7S," that corresponding to the central outboard motor 3C shall be referred to as the "central remote controller 7C," and that corresponding to the portside outboard motor 3P shall be referred to as the "portside remote controller 7P." Each remote controller 7 has a lever 7*a* capable of inclination in forward and reverse directions, and operation of the lever 7*a* is transmitted to the corresponding outboard motor 3 via a cable (not shown). By inclining the lever 7*a* forward from a predetermined neutral position, a shift position of the outboard motor 3 is set at a forward drive position and a propulsive force in the forward drive direction is generated from the outboard motor 3. By inclining the lever 7*a* in the reverse direction from the neutral position, the shift position of the outboard motor 3 is set at a reverse drive position and a propulsive force in the reverse drive direction is generated from the outboard motor 3. When the lever 7*a* is at the neutral position, the shift position of the outboard motor 3 is set at the neutral position and the outboard motor 3 does not generate a propulsive force. Further, the output of the outboard motor 3, that is, the engine speed provided in the outboard motor 3 can be varied according to the inclination amount of the lever 7*a*.

The operational panel 8 includes three start switches arranged to be operated by a user to start the engines of the three outboard motors 3 individually and three stop switches arranged to be operated by a user to stop the engines of the three outboard motors 3 individually.

Three gauges 9 are provided in correspondence to the three outboard motors 3. When these are to be distinguished, that corresponding to the starboard side outboard motor 3S shall be referred to as the "starboard side gauge 9S," that corresponding to the central outboard motor 3C shall be referred to as the "central gauge 9C," and that corresponding to the portside outboard motor 3P shall be referred to as the "portside gauge 9P." These gauges 9 display statuses of the corresponding outboard motors 3. More specifically, the gauges 9 display the power on/off state, the engine speed, and other necessary information on the corresponding outboard motor 3.

The marine vessel maneuvering compartment 5 further includes an immobilizer 10 (receiver). The immobilizer 10 receives signals from a key unit 11 to be carried by a user of the marine vessel 1 and is a device that allows ordinary use of the marine vessel 1 only to a legitimate user. The key unit 11 includes a lock button 12 and an unlock button 13. The lock button 12 is a button that is operated to set the immobilizer 10 in a locked state. By operation of the lock button 12, a lock signal is sent from the key unit 11. When the immobilizer 10 is set in the locked state, the marine vessel 1 is put in a state in which ordinary use is prohibited. The unlock button 13 is a button that is operated to release the locked state and set the immobilizer 10 in an unlocked state to start ordinary use of the marine vessel 1. By operation of the unlock button 13, an unlock signal is sent from the key unit 11. The key unit 11 sends a user authentication code along with the lock signal and the unlock signal.

The immobilizer 10 receives the user authentication code from the key unit 11 and executes a user authentication process. That is, the immobilizer 10 checks matching or non-matching with collation source data that are registered in advance. If the user authentication process succeeds, the immobilizer 10 accepts the lock signal and the unlock signal from the key unit 11. If the user authentication process fails, the immobilizer 10 becomes unresponsive to the lock signal and the unlock signal from the key unit 11.

Figure 2:
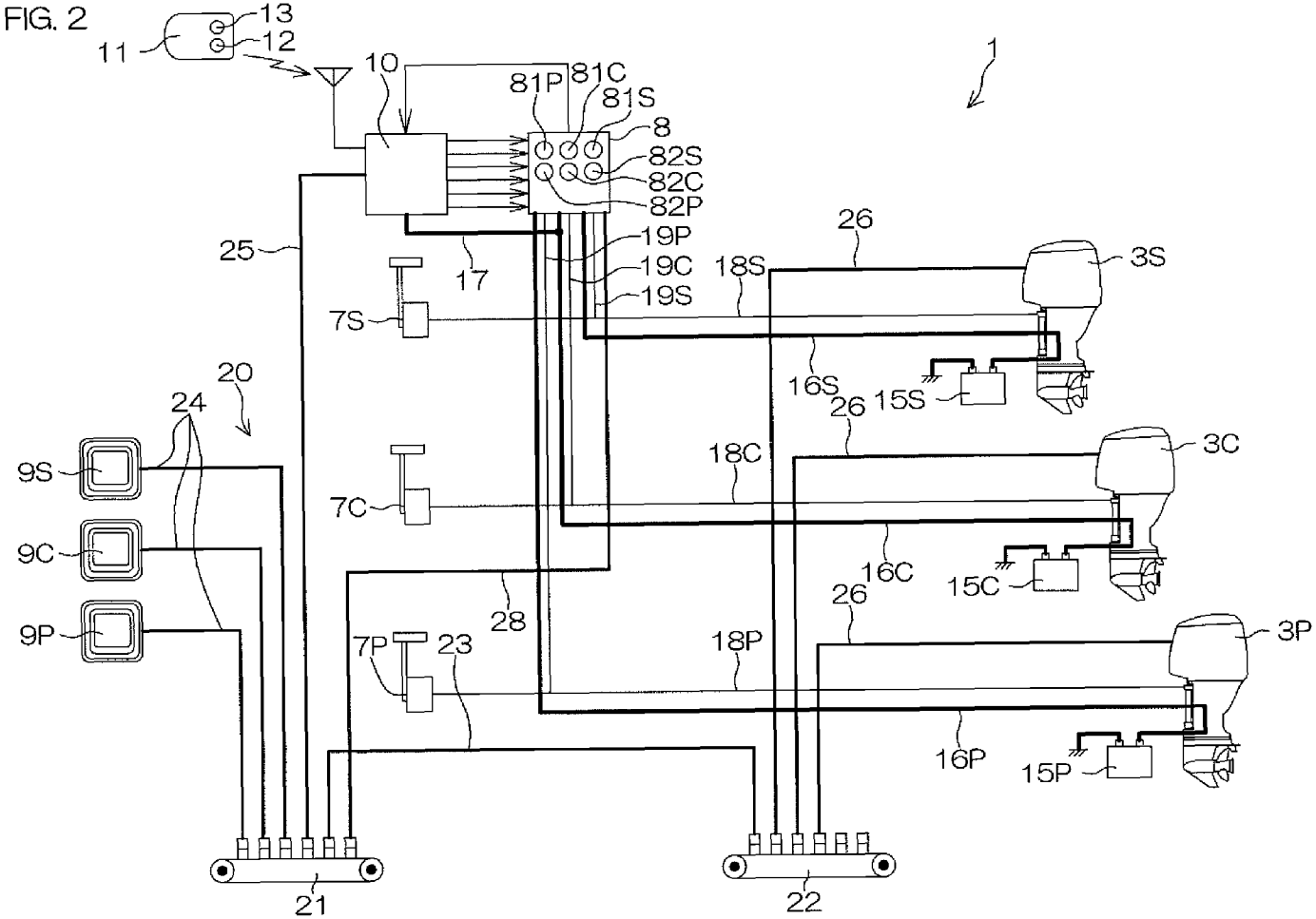
FIG. 2 is a diagram for explaining an electrical configuration of the marine vessel.

FIG. 2 is a diagram for explaining an electrical configuration of the marine vessel 1. The operational panel 8 includes three individually operable start switches 81S, 81C, and 81P, and three individually operable stop switches 82S, 82C, and 82P. Thus, three pairs of start switches and stop switches are provided in correspondence to the three outboard motors 3. The pair of the start switch 81S and the stop switch 82S corresponds to the starboard side outboard motor 3S. The pair of the start switch 81C and the stop switch 82C corresponds to the central outboard motor 3C. Likewise, the pair of the start switch 81P and the stop switch 82P corresponds to the portside outboard motor 3P. By individually operating the start switches 81S, 81C, and 81P, the engines of the three outboard motors 3 can be started individually. Also, by individually operating the stop switches 82S, 82C, and 82P, the engines of the three outboard motors 3 can be stopped individually.

Three batteries 15 are respectively disposed in correspondence to the three outboard motors 3. That is, a battery 15S corresponding to the starboard side outboard motor 3S, a battery 15C corresponding to the central outboard motor 3C, and a battery 15P corresponding to the portside outboard motor 3P are provided. These batteries 15S, 15C, and 15P are respectively connected via power supply cables 16S, 16C, and 16P to the outboard motors 3S, 3C, and 3P. The batteries 15 are not necessarily disposed close to the outboard motors 3 and are disposed at suitable locations of the hull 2 in accordance with a design of a boat builder.

Further, the power supply cables 16S, 16C, and 16P are drawn from the outboard motors 3S, 3C, and 3P to the operational panel 8. Power supply relays (not shown) disposed inside the operational panel 8 are individually interposed in the respective power supply cables 16S, 16C, and 16P. Further, a power supply line 17 is branched from a power supply cable 16 (for example, the power supply cable 16C) from a battery 15 (for example, the battery 15C) corresponding to a single, specific outboard motor 3 (for example, the central outboard motor 3C). The power supply line 17 is connected to the immobilizer 10. The immobilizer 10 thus always receives the supply of power from the battery 15.

Control signal lines 18S, 18C, and 18P are respectively connected to the outboard motors 3S, 3C, and 3P. The remote controllers 7S, 7C, and 7P are respectively connected to the control signal lines 18S, 18C, and 18P. The remote controllers 7S, 7C, and 7P generate remote controller authentication codes and send the codes to the control signal lines 18S, 18C, and 18P. An outboard motor 3 is put in an operation disabled state unless a remote controller authentication code that has been registered in advance is received. Further, starting signal lines 19S, 19C, and 19P of the operation panel 8 are respectively connected to the control signal lines 18S, 18C, and 18P. When starting commands are delivered to the starting signal lines 19S, 19C, and 19P, the starters of the corresponding outboard motors 3 are actuated in response and the engines are started.

An inboard LAN (local area network) 20 is constructed inside the hull 2. Specifically, the outboard motors 3, the immobilizer 10, and the gauges 9 are connected to the inboard LAN 20 and enabled to send and receive data and control signals. A stem side hub 21 is disposed close to the marine vessel maneuvering compartment 5, a stern side hub 22 is disposed at the stern side, and these are connected to each other via a LAN cable 23. To the stem side hub 21, the gauges 9 are connected via LAN cables 24 and the immobilizer 10 is connected via a LAN cable 25. The outboard motors 3 are connected via LAN cables 26 to the stern side hub 22. A system power for the inboard LAN 20 is supplied to the stem side hub 21 via a system power supply line 28 from a system power supply circuit (not shown) disposed inside the operational panel 8.

The LAN cables 23 to 26 are configured by binding power supply lines and signal lines. The LAN cables 23 to 26 are thus capable of sending power from the system power supply line 28 via the power supply lines and transmitting communication signals among the respective equipment via the signal lines. In particular, the supply of power to the gauges 9 is achieved via the system power supply line 28, the stem side hub 21, and the LAN cables 24.

Figure 3:
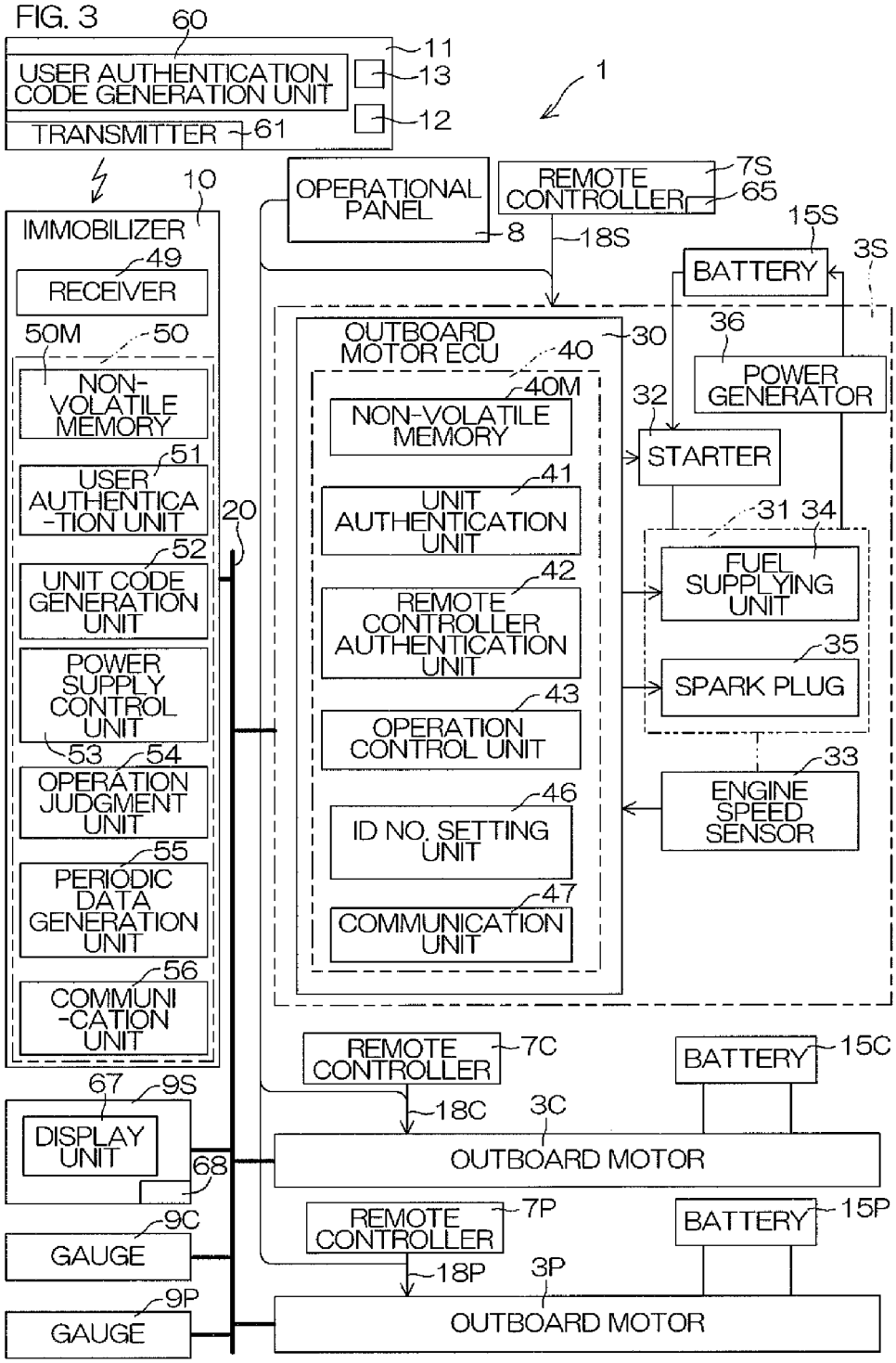
FIG. 3 is a block diagram for explaining the electrical configuration of the marine vessel in further detail.

FIG. 3 is a block diagram for explaining the electrical configuration of the marine vessel 1 in further detail. Each outboard motor 3 includes an outboard motor ECU (electronic control unit) 30, an engine 31, a starter 32, an engine speed sensor 33, and a power generator 36. The engine 31 includes a fuel supplying unit 34 and a spark plug 35. The fuel supplying unit 34 includes, for example, an injector that injects fuel into an air intake path of the engine 31. The spark plug 35 discharges inside a combustion chamber of the engine 31 and ignites a mixed gas inside the combustion chamber. Operations of the fuel supplying unit 34 and the spark plug 35 are controlled by the outboard motor ECU 30. The starter 32 is a device that rotates upon receiving power from the battery 15 and is arranged to perform cranking of the engine 31 by the rotational force. The engine speed sensor 33 detects the rotational speed of the engine 31 or more specifically, the rotational speed of a crankshaft. The power generator 36 has a rotor that is rotated by the driving force of the engine 31 and generates power by rotation of the rotor. The corresponding battery 15 is charged by this power.

The outboard motor ECU 30 includes a computer 40 (microcomputer) and drive circuits (not shown) that drive the fuel supplying unit 34, the spark plug 35, etc., and is connected to the inboard LAN 20. The computer 40 includes a CPU, a ROM, a RAM and other necessary memories, and interfaces. In particular, the computer 40 includes a non-volatile memory 40M (for example, a rewritable memory such as an EEPROM) for storing authentication source data for the immobilizer 10, authentication source data for the remote controller 7, etc.

By the CPU executing predetermined operation programs stored in the ROM, the computer 40 functions as a plurality of functional processing units. The functional processing units include a unit authentication unit 41, a remote controller authentication unit 42, an operation control unit 43, an ID No. setting unit 46, and a communication unit 47.

A function of the computer 40 as the unit authentication unit 41 is authentication of a unit authentication code sent by the immobilizer 10. More specifically, the computer 40 requests the immobilizer 10 to send the unit authentication code. In response, the immobilizer 10 sends the unit authentication code via the inboard LAN 20. The unit authentication code is received by the computer 40. The computer 40 collates the received unit authentication code with authentication source data (the legitimate unit authentication code) registered in advance in the non-volatile memory 40M and generates the collation result (success or failure).

A function of the computer 40 as the remote controller authentication unit 42 is authentication of a remote controller authentication code sent by each remote controller 7. More specifically, the computer 40 receives the remote controller authentication code from the corresponding remote controller 7 via the control signal line 18. Further, the computer 40 collates the received remote controller authentication code with authentication source data (the legitimate remote controller authentication code) registered in advance in the non-volatile memory 40M and generates the collation result (success or failure).

Functions of the computer 40 as the operation control unit 43 include allowing of operation (allowing of starting) and prohibition of operation (prohibition of starting) of the outboard motors 3. Specifically, the computer 40 receives data expressing whether the immobilizer 10 is in the locked state or in the unlocked state from the immobilizer 10 via the inboard LAN 20. When the immobilizer 10 is in the unlocked state and the unit authentication result and the remote controller authentication result are both "successful," the computer 40 allows the operation of the outboard motors 3.

Functions of the computer 40 as the operation control unit 43 further include actuation of the starters 32 in response to the starting commands provided via the corresponding control signal line 18 from the operation panel 8. The corresponding engine 31 is thereby started. Functions of the computer 40 as the operation control unit 43 further include control of stopping of the corresponding engine 31 in response to a stop command provided from the operational panel 8 and via the corresponding control signal line 18. Specifically, the corresponding engine 31 is stopped by stoppage of fuel supply by the fuel supplying unit 34 and stoppage of the ignition operation by the spark plug 35.

A function of the computer 40 as the ID No. setting unit 46 is to determine an ID No., which is a unique identification number on the inboard LAN 20, and set it in the corresponding outboard motor 3. The setting of the ID No. is a part of an initial setting, and once the initial setting is performed, the ID No. of the corresponding outboard motor 3 is registered and saved in the non-volatile memory 40M. The initial setting is performed when the setting of the ID No. is incomplete when the power of the outboard motor ECU 30 is turned on.

A function of the computer 40 as the communication unit 47 is communication with other equipments connected to the inboard LAN 20. Locked or unlocked state data can be acquired from the immobilizer 10, display commands can be provided to the gauges 9, for example, by this communication.

The immobilizer 10 includes a receiver 49 and a computer 50 (microcomputer). The receiver 49 receives the signal from the key unit 11 and transfers the signal to the computer 50. The computer 50 includes a CPU, a ROM, a RAM and other necessary memories. In particular, the computer 50 includes a non-volatile memory 50M (for example, a rewritable memory such as an EEPROM). The collation source data (the legitimate user identification code) for collating the user identification code generated by the key unit 11 are registered in advance in the non-volatile memory 50M.

By execution of predetermined programs stored in the ROM, the computer 50 functions as a plurality of functional processing units. The functional processing units include a user authentication unit 51, a unit code generation unit 52, a power supply control unit 53, an operation judgment unit 54, a periodic data generation unit 55, and a communication unit 56.

A function of the computer 50 as the user authentication unit 51 is to collate the user identification code transmitted from the key unit 11 with the collation source data registered in advance in the non-volatile memory 50M. More specifically, the computer 50 acquires the user identification code received by the receiver 49. Further, the computer 50 collates the acquired user identification code and the authentication source data registered in advance in the non-volatile memory 50M and generates the collation result (success or failure).

A function of the computer 50 as the unit code generation unit 52 is to generate the unit authentication code in response to a request from any of the outboard motor ECUs 30 provided in the outboard motors. That is, the outboard ECU 30 provides a unit authentication code request to the immobilizer 10. In response, the unit code generation unit 52 sends the unit authentication code to the inboard LAN 20. The unit authentication code is an authentication code unique to the immobilizer 10. Authentication with respect to the unit authentication code is performed in the outboard motor ECU 30 (function of the unit authentication unit 41). The unit authentication code maybe handled in an encrypted form. In this case, the outboard motor ECU 30 provides the unit authentication code request that includes an encryption key (for example, a random number) to the immobilizer 10. In response, the unit code generation unit 52 sends the unit authentication code encrypted using the encryption key to the inboard LAN 20. In the outboard motor ECU 30, the encrypted unit authentication code is decrypted and the decrypted unit authentication code is collated with the authentication source data.

A function of the computer 50 as the power supply control unit 53 is to control the power supplies to the outboard motors 3 by controlling the power supply relays, etc., equipped in the operational panel 8. More specifically, when the unlock signal is received from the key unit 11 and the user authentication succeeds, the computer 50 turns on the power supplies of all of the outboard motors 3.

A function of the computer 50 as the operation judgment unit 54 is to judge the operation states of the respective outboard motors 3. The computer 50 acquires the engine speed information from each outboard motor ECU 30 via the inboard LAN 20 and judges whether or not the engine 31 of each outboard motor 3 is in operation.

A function of the computer 50 as the periodic data generation unit 55 is to generate the periodic data at the fixed period or cycle. The computer 50 generates the periodic data constantly during a term in which it is supplied with power and is operating. The periodic data includes state data that indicate whether the immobilizer 10 is in the locked state or the unlocked state. The state data thus indicate the user authentication result (success or failure) with respect to an unlock operation for releasing the locked state of the immobilizer 10. The periodic data are sent at the fixed period to the inboard LAN by the function of the communication unit 56 to be described next.

A function of the computer 50 as the communication unit 56 is to send various signals to the inboard LAN 20 and acquire various signals from the inboard LAN 20. More specifically, the computer 50 sends the unit authentication code and the periodic data to the inboard LAN 20. Meanwhile, the computer 50 acquires the rotational speed information of the engine 31 of each outboard motor 3 via the inboard LAN 20.

As mentioned above, the key unit 11 includes the lock button 12 and the unlock button 13. The key unit 11 further includes a user authentication code generation unit 60 that is arranged to generate the user authentication code and a transmitter 61. The transmitter 61 is arranged to transmit the lock signal to the immobilizer 10 when the lock button 12 is operated and transmit the unlock signal to the immobilizer 10 when the unlock button 13 is operated. Further, in sending these signals, the transmitter 61 transmits the user authentication code together to the immobilizer 10.

Each remote controller 7 includes a remote controller authentication code generation unit 65. The remote controller authentication code generated by the remote controller authentication code generation unit 65 is transmitted to the outboard motor ECU 30 of the corresponding outboard motor 3 via the control signal line 18. An authentication process using the remote controller authentication code is performed by the computer 40 of the outboard motor ECU 30 (function as the remote controller authentication unit 42).

Each gauge 9 includes a display unit 67, which includes a liquid crystal display panel, etc., and a gauge number setting unit 68. The gauge number setting unit 68 includes, for example, a setting switch. Any one of a plurality of gauge numbers set in advance can be selected and set by operation of the setting switch. Each outboard motor ECU 30 sends the operation state data to the inboard LAN 20, designating, as a destination, the gauge 9 having the gauge number corresponding to the ECU's own equipment identification number. The operation state of the corresponding outboard motor 3 is displayed on the display unit 67 in the gauge 9 that received the operation state data. The displayed operation state includes, for example, information indicating whether or not the engine 31 is in operation and the engine speed information.

Figure 4:
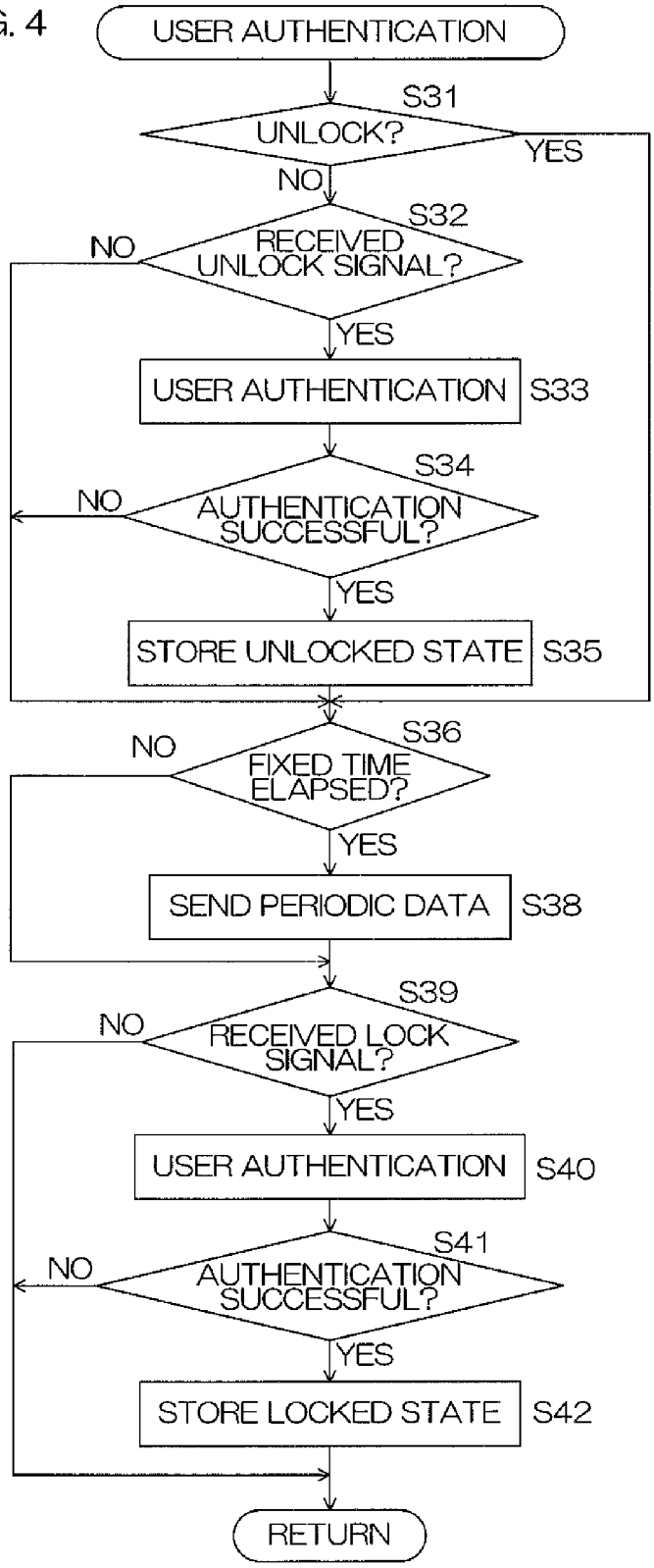
FIG. 4 is a flowchart for explaining processes executed by a computer of an immobilizer.

FIG. 4 is a flowchart for explaining processes that are repeatedly executed by the computer 50 of the immobilizer 10 at a predetermined control period or cycle (for example, a period of about 10 milliseconds). The computer 50 stores the state data indicating the unlocked state or the locked state in an internal memory. An initial value of the state data is the locked state. By referencing the state data, the computer 50 judges whether or not the immobilizer 10 is in the unlocked state (step S31).

In the case of the locked state (step S31: NO), the computer 50 judges whether or not the unlock signal is received (step S32). If the unlock signal is received (step S32: YES), the computer 50 executes the user authentication process (step 33). Specifically, the computer 50 collates the user authentication code, sent along with the unlock signal from the key unit 11, with the authentication source data (the legitimate user authentication code) registered in advance in the memory 50M. If the user identification code and the authentication source data match, authentication is successful (step S34: YES), and the computer 50 rewrites the state data in the internal memory to the unlocked state (step S35).

If the unlock signal is not received (step S32: NO), the computer 50 omits the processes of steps S33 to S35. That is, the locked or unlocked state is maintained in the current state. Even if the unlock signal is received, if the authentication fails (step S34: NO), the computer 50 skips the process of step S35. That is, the locked or unlocked state is maintained in the current state. In the unlocked state (step S31), the processes of steps S32 to S35 are omitted.

The computer 50 sends the periodic data to the inboard LAN 20 at a fixed time interval (for example, a 200 millisecond interval) (steps S36 and S38). The periodic data include the state data that indicate whether the immobilizer 10 is in the unlocked state or the locked state. In the present preferred embodiment, the periodic data are used in the outboard motor ECU 30 for fault detection of the immobilizer 10.

The computer 50 also judges whether or not the lock signal is received from the key unit 11 (step S39). If the lock signal is received (step S39: YES), the user authentication code, sent along with the lock signal from the key unit 11, is collated with the authentication source code registered in advance in the memory 50M (step S40). If the lock signal is not received, the computer 50 ends the processes of the current control period. That is, the locked or unlocked state is maintained in the present state.

If the user authentication process succeeds (step S41: YES), the computer 50 writes the state data, indicating the locked state, in the internal memory under certain conditions (step S42). The certain conditions include that the engine 31 is in a stopped state in all outboard motors 3. That is, if an engine 31 of any of the outboard motors 3 is in operation, the lock signal from the key unit 11 is ignored and the unlocked state is maintained. If the user authentication process fails (step S41: NO), the computer 50 ends the processes of the current control period. That is, the locked or unlocked state is maintained in the present state.

The computer 50 also generates the unit authentication code in response to a request from the outboard motor ECU 30 and sends the unit authentication code to the outboard motor ECU 30 via the inboard LAN 20. When the power of the outboard motor 3 is turned on, the computer 40 of the outboard motor ECU 30 requests the immobilizer 10 to send the unit authentication code. If the immobilizer 10 is in the unlocked state, it sends an appropriate response signal that includes the unit authentication code. The unit authentication process in the outboard motor ECU 30 thus succeeds. If the immobilizer 10 is in the locked state when it receives the unit authentication code send request, it sends an illegitimate response signal. The unit authentication process thus fails. When the state of the immobilizer 10 transitions to the unlocked state thereafter and the state data in the periodic data changes to data indicating "unlocked," the computer 40 of the outboard motor ECU 30, in response, requests the sending of the unit authentication code again. At this time, the immobilizer 10 sends the appropriate response signal that includes the unit authentication code. The unit authentication process in the outboard motor ECU 30 thus succeeds.

Figure 5:
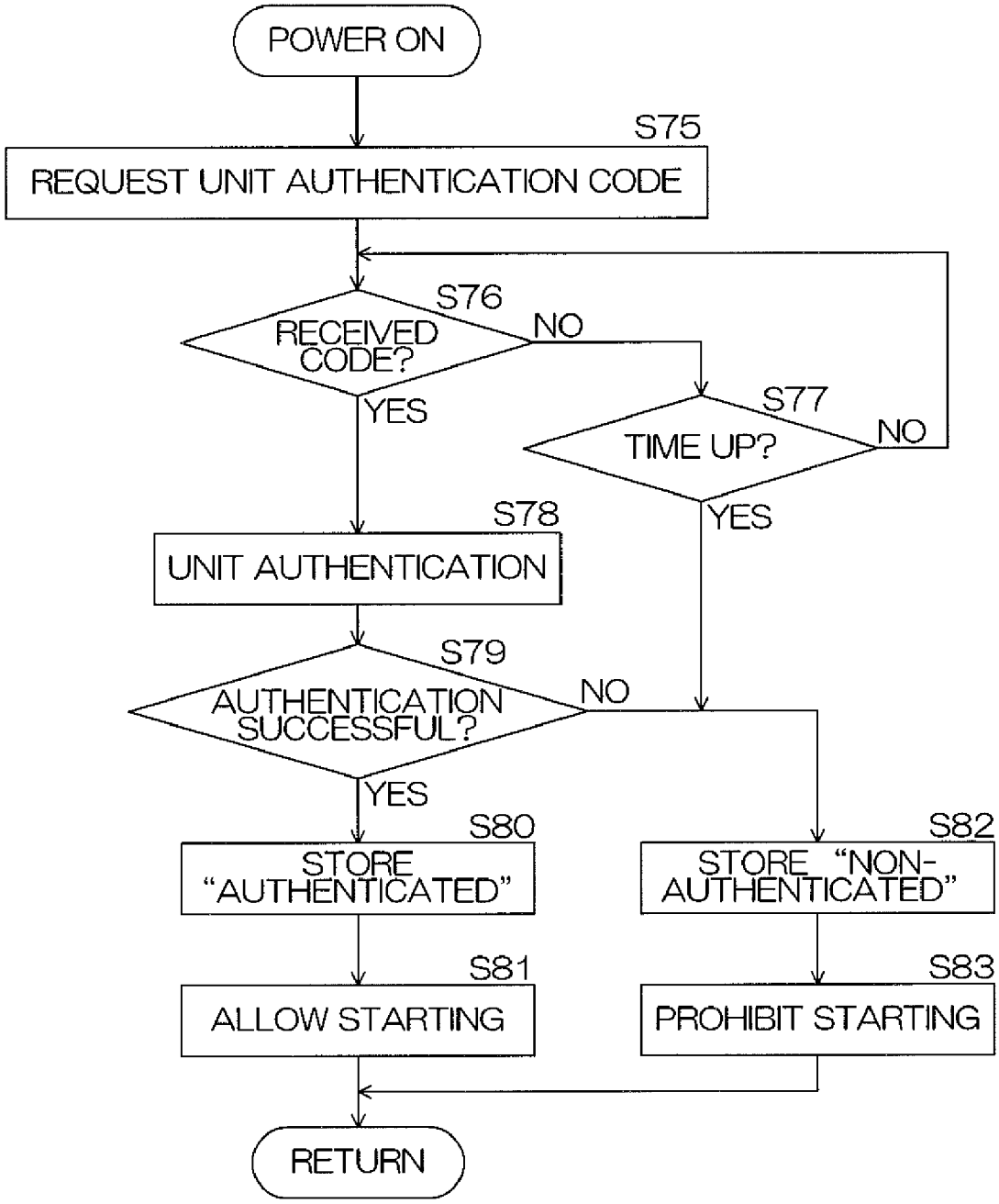
FIG. 5 is a flowchart for explaining contents of processes executed by a computer of an outboard motor ECU.

FIG. 5 is a flowchart for explaining contents of processes that are executed by the computer 40 of an outboard motor ECU 30 when the power supply of the corresponding outboard motor 3 is turned on. When the power supply of the outboard motor 3 is turned on and the supply of power to the outboard motor ECU 30 is started, the computer 40 issues a unit authentication code send request to the immobilizer 10 (step S75). The computer 40 then waits for a response to the unit authentication code send request (steps S76 and S77). If a response from the immobilizer 10 is not received for a predetermined time (for example, 1 second), it is deemed that the waiting time is up. In this case, the computer 40 sets the authentication state data in the internal memory to "non-authenticated" (step S82) and prohibits the starting of the engine 31 (step 83). "Non-authenticated" indicates that the authentication process of the immobilizer 10 is incomplete. When the authentication process of the immobilizer 10 succeeds, the computer 40 changes the authentication state data to "authenticated." In the following description, the state where the authentication state data is "non-authenticated" shall be referred to as the "non-authenticated state," and the state where the authentication state data is "authenticated" shall be referred to as the "authenticated state." An initial value of the authentication state data is "non-authenticated." The initial value is the value immediately after the power supply of the outboard motor ECU 30 has been turned on. The process in step S82 is thus actually a process of not changing the initial value of the authentication state data.

If the unit authentication code is received from the immobilizer 10 before the waiting time runs out (step S76: YES), the computer 40 executes the unit authentication process (step S78; function as the unit authentication unit 41). The unit authentication process is a process of collating the unit authentication code, sent from the immobilizer 10, with the authentication source data stored in the memory 40M. If the unit authentication process succeeds (step S79: YES), the computer 40 changes the authentication state data into "authenticated" (step S80). Starting of the engine 31 is thereby allowed (Step S81). If the unit authentication process fails (step S79: NO), the authentication state data are set to "non-authenticated" (step S82) and the starting of the engine 31 is prohibited (step S83).

Thus, with the present preferred embodiment, the immobilizer 10 is disposed apart from the outboard motor 3. The immobilizer 10 can thus be protected against the weather and yet be disposed at any position (such as near the maneuvering compartment) at which radio waves from the key unit 11 arrive without fail. Also, when maintenance of the immobilizer 10 is necessary, it can be removed and brought to a service center of a dealer, etc. There is thus no need to transport the marine vessel 1 or to remove and transport the outboard motor 3 for maintenance.

For example, when the user loses the key unit 11 and a need to register a user authentication code of a new key unit on the immobilizer 10 arises, the immobilizer 10 can be removed from the hull 2 and brought to the service center.

More specifically, when the immobilizer 10 is first installed, a plurality (for example, two) of key units 11 registered on the immobilizer 10 are handed over to the user. Even when the user loses one of these key units, access to the immobilizer 10 is enabled by use of the single, remaining key unit 11. By then using this key unit 11 to access the immobilizer 10, the user authentication code of another new key unit can be registered in the non-volatile memory 50M of the immobilizer 10.

A case where a thief removes the immobilizer 10 to steal the marine vessel 1 or the outboard motor 3 shall now be considered. In this case, the computer 40 of the outboard motor ECU 30 cannot receive the unit authentication code from the immobilizer 10. The engine 31 thus cannot be started. At least one registered key unit is required for registration of the unit authentication code in the outboard motor ECU 30. Thus, even if the immobilizer 10 is removed, the engine 31 cannot be started. Obviously, as long as the engine 31 cannot be started, the marine vessel 1 and the outboard motor 3 have no practical economic value and provide no profit as an object of theft to the thief. A theft deterrent effect can thus be achieved.

Figure 6:
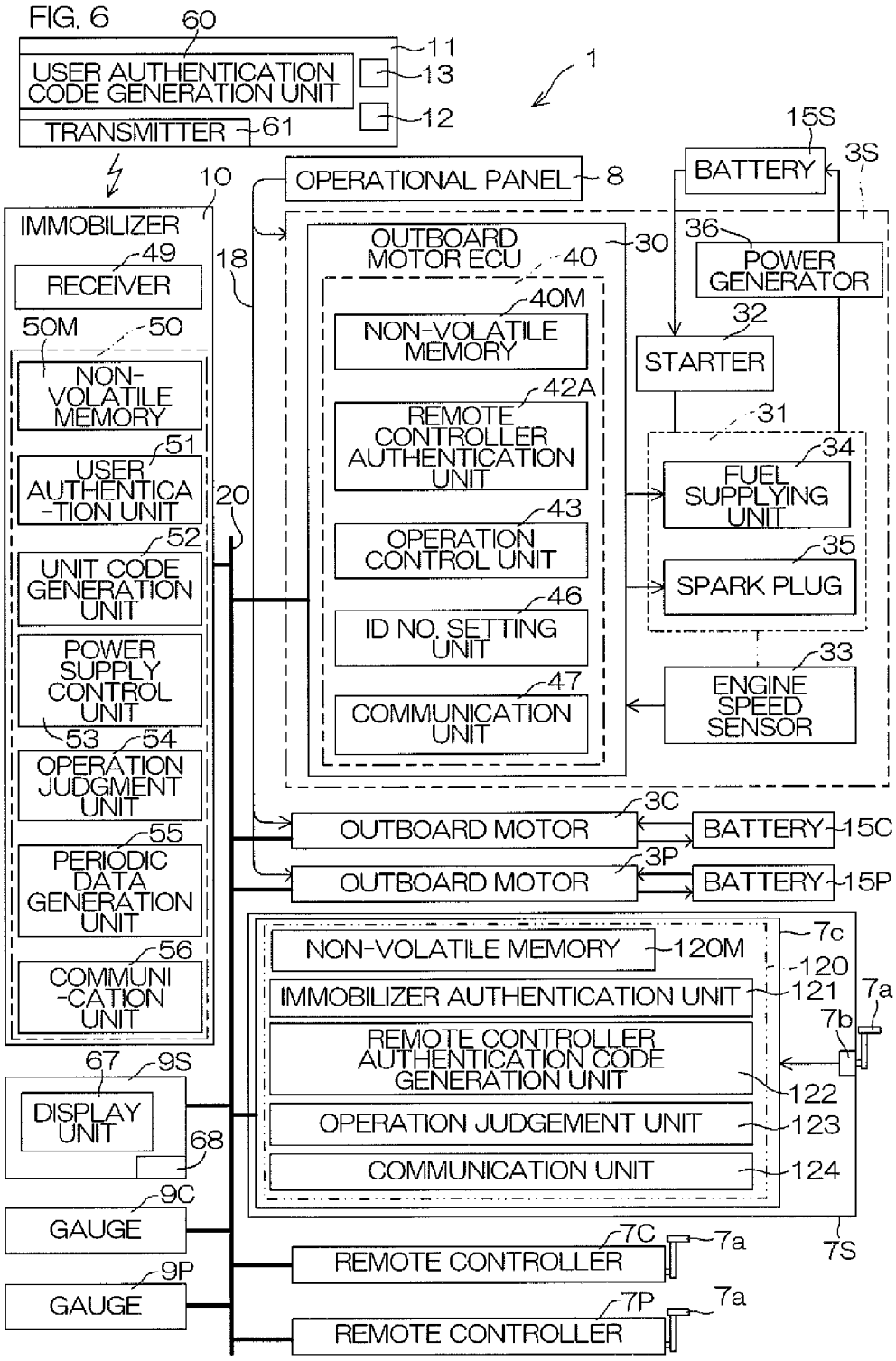
FIG. 6 is a block diagram for explaining a configuration related to another preferred embodiment of the present invention.

FIG. 6 is a block diagram for explaining a configuration related to another preferred embodiment of the present invention. In FIG. 6, portions corresponding to the respective portions shown in FIG. 3 are indicated by the same reference symbols. In the present preferred embodiment, each of the remote controllers 7 (the starboard side remote controller 7S, the central remote controller 7C, and the portside remote controller 7P) preferably includes a lever 7*a*, a position sensor 7*b*, and a remote controller ECU (electronic control unit) 7*c*. The position sensor 7*b* detects an operation position of the lever 7*a*. The remote controller ECU 7*c* is connected to the inboard LAN 20. The remote controller ECU 7*c* sends the operation position information detected by the position sensor 7*b* to the corresponding outboard motor ECU 30 via the inboard LAN 20. The outboard motor ECU 30 adjusts the shift position and the engine speed of the outboard motor 3 according to the operation position information sent from the corresponding remote controller ECU 7*c*. Power supplies of the respective remote controllers 7S, 7C, and 7P are turned on and off in linkage with the corresponding outboard motors 3S, 3C, and 3P.

Each remote controller ECU 7*c* includes a computer 120 (microcomputer). The computer 120 includes a CPU, a ROM, a RAM and other necessary memories. The computer 120 includes a non-volatile memory 120M (for example, a rewritable memory such as an EEPROM). The authentication source data of the unit authentication code sent by the immobilizer 10 and a remote controller authentication code unique to the corresponding remote controller 7 are stored in the non-volatile memory 120M.

By executing predetermined programs stored in the ROM, the computer 120 can function as a plurality of functional processing units. The functional processing units include an immobilizer authentication unit 121, a remote controller authentication code generation unit 122, an operation judgment unit 123, and a communication unit 124.

A function of the computer 120 as the immobilizer authentication unit 121 is to perform an authentication process of collating the unit authentication code sent by the immobilizer 10 with the collation source data (the legitimate unit authentication code) stored in the non-volatile memory 120M. More specifically, the computer 120 requests the immobilizer 10 to send the unit authentication code. In response, the unit authentication code is sent from the immobilizer 10 via the inboard LAN 20. This unit authentication code is received by the computer 120. The computer 120 collates the received unit authentication code with the authentication source data (the legitimate unit authentication code) registered in advance in the non-volatile memory 120M and generates the collation result (success or failure). The unit authentication code request generated by the computer 120 may include an encryption key (for example, a random number) In this case, the unit code generation unit 52 of the immobilizer 10 sends, in response to the unit authentication code request, the unit authentication code that is encrypted using the encryption key to the inboard LAN 20. The computer 120 receives and decrypts the encrypted unit authentication code and collates the decrypted unit authentication code with the authentication source data.

A function of the computer 120 as the remote controller authentication code generation unit 122 is to read and generate the remote controller authentication code unique to the corresponding remote controller 7 from the non-volatile memory 120M. More specifically, the computer 120 generates the remote controller authentication code in accordance with a request from the outboard motor ECU 30. That is, the outboard motor ECU 30 provides a remote controller authentication code request to the remote controller 7. In response, the remote controller authentication code generation unit 122 sends the remote controller authentication code to the inboard LAN 20. The remote controller authentication code is an authentication code unique to the corresponding remote controller 7. Authentication of the remote controller authentication code is performed in the outboard motor ECU 30 (the function of the remote controller authentication unit 42A). The remote controller authentication code may be handled in an encrypted form. In this case, the outboard motor ECU 30 provides the remote controller authentication code request including an encryption key (for example, a random number) to the remote controller 7. In response, the remote controller authentication code generation unit 122 sends the remote controller authentication code encrypted using the encryption key to the inboard LAN 20. In the outboard motor ECU 30, the encrypted remote controller authentication code is decrypted and the decrypted remote controller authentication code is collated with the authentication source data.

A function of the computer 120 as the operation judgment unit 123 is to acquire information concerning the operation state of the corresponding outboard motor 3 (specifically, the engine speed) from the inboard LAN 20 and judge whether the engine 31 of the corresponding outboard motor 3 is in an operating state or a stopped state.

A function of the computer 120 as the communication unit 124 is to perform communication with other equipment via the inboard LAN 20. More specifically, the computer 120 receives the unit authentication code generated by the immobilizer 10 from the inboard LAN 20 and sends the remote controller authentication code of the corresponding remote controller 7 to the inboard LAN 20.

In the present preferred embodiment, the authentication process of the user authentication code generated by the key unit 11 is executed by the immobilizer 10, and the authentication process of the unit authentication code generated by the immobilizer 10 is executed by the computer 120 of the remote controller ECU 7*c*. The authentication process of the remote controller authentication code generated by the remote controller ECU 7*c* is executed in the outboard motor ECU 30.

The functions of the computer 40 of the outboard motor ECU 30 of each outboard motor 3 do not include the function as the unit authentication unit 42 in the previously described first preferred embodiment but includes the function as the remote controller authentication unit 42A. The function of the remote controller authentication unit 42A is the authentication process of collating the remote controller authentication code sent from the remote controller ECU 7*c* with the collation source data (the legitimate remote controller authentication code) registered in advance in the non-volatile memory 40M.

The immobilizer 10 performs the authentication process of the user authentication code for example by executing the process shown in FIG. 4.

Figure 7:
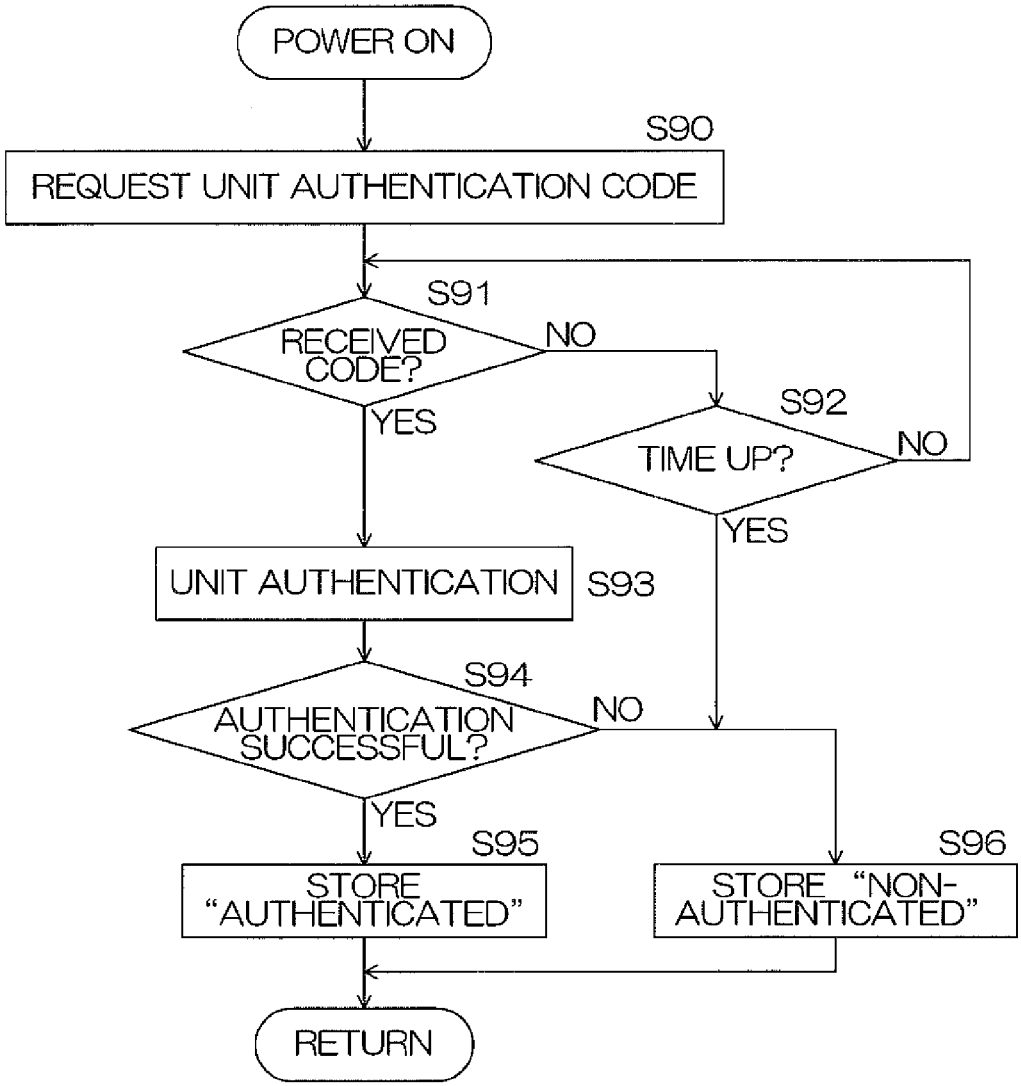
FIG. 7 is a flowchart for explaining a unit authentication process executed by a computer of a remote controller ECU in the preferred embodiment of FIG. 6.

FIG. 7 is a flowchart for explaining the unit authentication process executed by the computer 120 of the remote controller ECU 7*c* when the power supply of the remote controller 7 is turned on. When the power supply of the remote controller 7 is turned on and the supply of power to the remote controller ECU 7*c* is started, the computer 120 issues the unit authentication code send request to the immobilizer 10 (step S90). The computer 120 then waits for a response to the unit authentication code send request (steps S91 and S92). If a response from the immobilizer 10 is not received for a predetermined time (for example, 1 second), it is deemed that the waiting time is up. In this case, the computer 120 sets the authentication state data in the internal memory to "non-authenticated" (step S96). "Non-authenticated" indicates that the authentication process of the immobilizer 10 is incomplete. When the authentication process of the immobilizer 10 succeeds, the computer 120 changes the authentication state data to "authenticated." In the following description, the state where the authentication state data is "non-authenticated" shall be referred to as the "non-authenticated state," and the state where the authentication state data is "authenticated" shall be referred to as the "authenticated state." An initial value of the authentication state data is "non-authenticated." The initial value is the value immediately after the power supply of the remote controller ECU 7*c* has been turned on. The process in step S96 is thus actually a process of not changing the initial value of the authentication state data.

If the unit authentication code is received from the immobilizer 10 before the waiting time runs out (step S91: YES), the computer 120 executes the unit authentication process (step S93; function as the immobilizer authentication unit 121). The unit authentication process is a process of collating the unit authentication code, sent from the immobilizer 10, with the authentication source data stored in the memory 120M. If the unit authentication process succeeds (step S94: YES), the computer 120 changes the authentication state data into "authenticated" (step S95). If the unit authentication process fails (step S94: NO), the authentication state data are set to "non-authenticated" (step S96).

Figure 8:
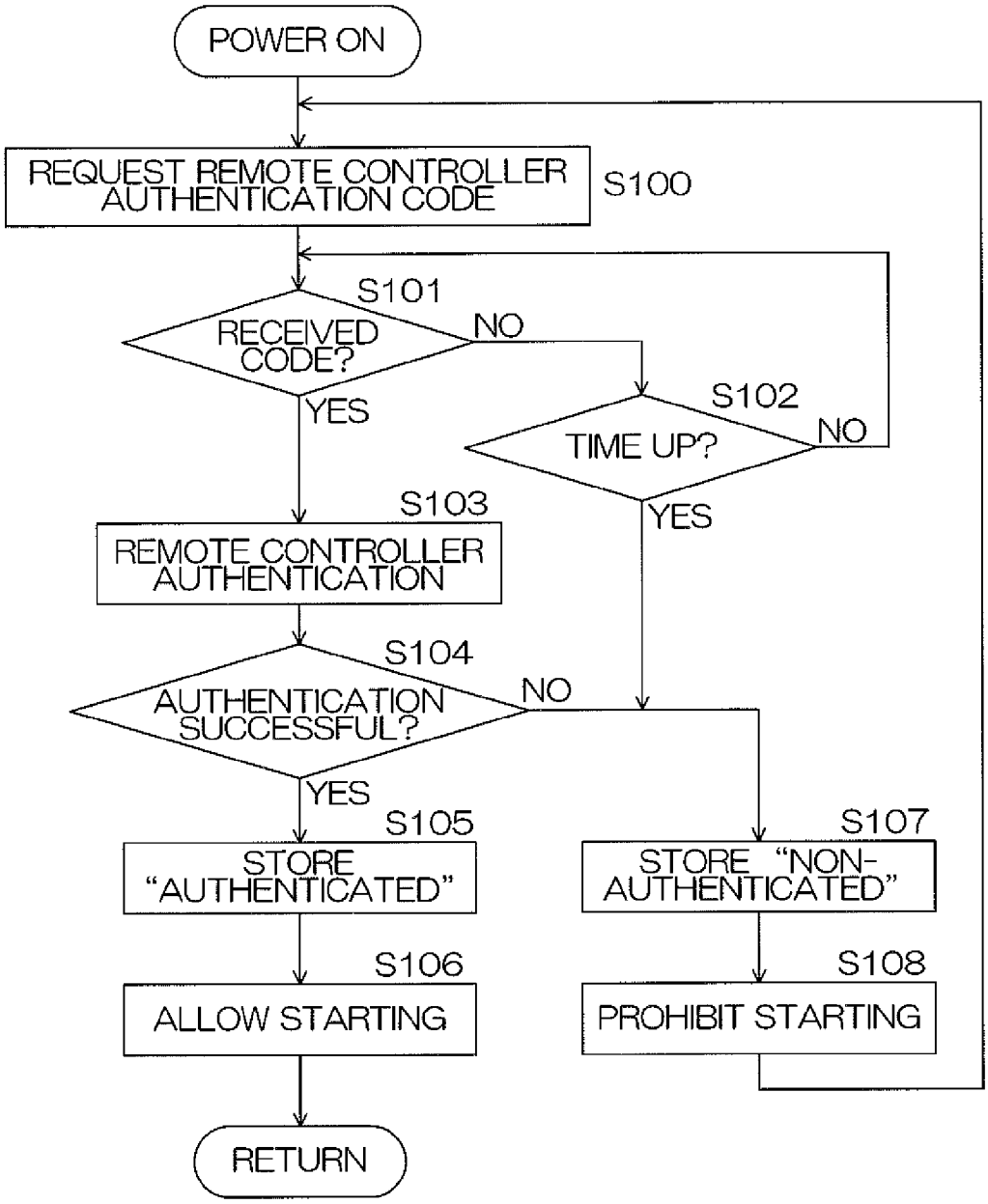
FIG. 8 is a flowchart for explaining contents of processes executed by a computer of an outboard motor ECU in the preferred embodiment of FIG. 6.

FIG. 8 is a flowchart for explaining contents of processes executed by the computer 40 of the outboard motor ECU 30 when the power supply of the outboard motor 3 is turned on. When the power supply of the outboard motor 3 is turned on and the supply of power to the outboard motor ECU 30 is started, the computer 40 issues a remote controller authentication code send request to the remote controller 7 (step S100). The computer 40 then waits for a response to the remote controller authentication code send request (steps S101 and S102). If a response from the remote controller 7 is not received for a predetermined time (for example, 1 second), it is deemed that the waiting time is up. In this case, the computer 40 sets the authentication state data in the internal memory to "non-authenticated" (step S107) and prohibits the starting of the engine 31 (step S108). "Non-authenticated" indicates that the authentication process of the remote controller 7 is incomplete. When the authentication process of the remote controller 7 succeeds, the computer 40 changes the authentication state data to "authenticated." In the following description, the state where the authentication state data is "non-authenticated" shall be referred to as the "non-authenticated state," and the state where the authentication state data is "authenticated" shall be referred to as the "authenticated state." An initial value of the authentication state data is "non-authenticated." The initial value is the value immediately after the power supply of the outboard motor ECU 30 has been turned on. The process in step S107 is thus actually a process of not changing the initial value of the authentication state data.

After step S107, the processes from step S100 are repeated (retry of authentication sequence).

If the remote controller authentication code is received from the remote controller 7 before the waiting time runs out (step S101: YES), the computer 40 executes the remote controller authentication process (step S103; function as the remote controller authentication unit 41A). The remote controller authentication process is a process of collating the remote controller authentication code, sent via the inboard LAN 20 from the remote controller 7, with the authentication source data stored in the memory 40M. If the remote controller authentication process succeeds (step S104: YES), the computer 40 changes the authentication state data to "authenticated" (step S105), allows starting of the engine 31 (Step S106). If the remote controller authentication process fails (step S104: NO), the non-authenticated state is maintained (step S107) and the starting of the engine 31 is prohibited (step S108).

When the authentication state data stored in the internal memory indicate "non-authenticated," the remote controller ECU 7*c* sends an illegitimate parameter in response to the remote controller authentication code request from the outboard motor ECU 30. The remote controller authentication process (step S103) in the outboard motor ECU 30 thus fails and the starting of the engine 31 is prohibited. On the other hand, when the authentication state data stored in the internal memory indicate "authenticated," the remote controller ECU 7*c* responds to the remote controller authentication code request from the outboard ECU 30 with the legitimate remote controller authentication code. The remote controller authentication process (step S103) in the outboard motor ECU 30 thus succeeds and the starting of the engine 31 is allowed.

Thus, with the present preferred embodiment, the authentication (user authentication) of the user authentication code generated by the key unit 11 is performed by the immobilizer 10. When this authentication succeeds, the immobilizer 10 generates the legitimate unit authentication code in response to the unit authentication code request from the remote controller 7. The authentication (unit authentication) of the unit authentication code is performed by the remote controller 7. When this authentication succeeds, the remote controller ECU 7 generates the legitimate remote controller authentication code in response to the remote controller authentication code request from the outboard motor ECU 30. The authentication (remote controller authentication) of the remote controller authentication code is then performed in the outboard motor 3, and when the authentication succeeds, the starting of the engine 31 is allowed. The starting of the engine 31 is thus allowed only in the case where the user authentication, the unit authentication, and the remote controller authentication are all successful, and otherwise, the starting of the engine 31 is prohibited. Even if the immobilizer 10 is removed, the engine 31 cannot be started, and a theft deterrent effect is thus obtained.

Such a configuration is convenient in a case of adding a theft deterrent function to a system in which a configuration for authentication of the remote controller 7 is established.

While two preferred embodiments of the present invention have thus been described, the present invention may be embodied in many other ways. For example, although in the preferred embodiments described above, the periodic data, including the state data indicating the locked or unlocked state, preferably are generated from the immobilizer 10, the generation of the periodic data is not necessarily required.

In the preferred embodiments described above, the outboard motor ECU 30 determines whether to allow or prohibit the starting of the engine according to the result of the authentication process of the unit authentication code (first preferred embodiment) or the remote controller authentication code (second preferred embodiment). In addition to those, a determination process using the periodic data may be added to the processes in the outboard motor 30. For example, the outboard motor ECU 30 may operate so as to allow the starting of the engine 31 if the periodic data that include the state data indicating the unlocked state are confirmed upon success of the unit authentication process or the remote controller authentication process.

Also, although in the preferred embodiments described above, the outboard motor is described as an example of the propulsion device, the present invention can be applied to marine vessels using propulsion devices of other forms. Other examples of the propulsion device include an inboard/outboard motor (a stern drive or an inboard motor/outboard drive), an inboard motor, and a water jet drive. The outboard motor includes a propulsion unit provided outboard of the vessel and having a motor and a propulsive force generating member (propeller), and a steering mechanism, which horizontally turns the entire propulsion unit with respect to the hull. The inboard/outboard motor includes a motor provided inboard of the vessel, and a drive unit provided outboard and having a propulsive force generating member and a steering mechanism. The inboard motor includes a motor and a drive unit incorporated in the hull, and a propeller shaft extending outboard from the drive unit. In this case, a steering mechanism is separately provided. The water jet drive has a configuration such that water sucked from the bottom of the marine vessel is accelerated by a pump an dejected from an ejection nozzle provided at the stern of the marine vessel to obtain a propulsive force. In this case, the steering mechanism includes the ejection nozzle and a mechanism for turning the ejection nozzle in a horizontal plane.

A non-limiting example of correspondence between claim terms and the terms used in the above description of the preferred embodiments is shown below:

propulsion device : outboard motor 3 key unit: key unit 11 first authentication unit: immobilizer 10 second authentication unit: unit authentication unit 41 and immobilizer authentication unit 121 operation control unit: operation control unit 43, steps S74, S76, and S78; S104, S106, and S107 operational unit: remote controller 7 third authentication unit: remote controller authentication unit 42A

While the present invention has been described in detail by way of the preferred embodiments thereof, it should be understood that these preferred embodiments are merely illustrative of the technical principles of the present invention but not limitative of the present invention. The spirit and scope of the present invention are to be limited only by the appended claims.

This application corresponds to Japanese Patent Application No. 2008-214383 filed in the Japanese Patent Office on Aug. 22, 2008, the whole disclosure of which is incorporated herein by reference.

What is claimed is:

1. A marine vessel theft deterrent apparatus for a marine vessel which includes a plurality of propulsion devices, the theft deterrent apparatus comprising:

a keypad remote arranged to transmit a user authentication code; and a first computer including a first authentication unit, disposed at a maneuvering compartment of the marine vessel apart from the plurality of propulsion devices, and arranged to receive the user authentication code transmitted by the keypad remote, to execute an authentication process on the user authentication code, and to generate a unit authentication code;

a second computer including a second authentication unit and an operation control unit;

the second authentication unit, disposed in each of the plurality of propulsion devices, being arranged to receive the unit authentication code generated by the first authentication unit and to execute an authentication process on the unit authentication code; and the operation control unit, disposed in each of the plurality of propulsion devices, being arranged to allow operation of a corresponding propulsion device of the plurality of propulsion devices if authentication by the second authentication unit does succeed, and to prohibit operation of the corresponding propulsion device if the authentication by the second authentication unit does not succeed.

2. The marine vessel theft deterrent apparatus according to claim 1, wherein the operation control unit is arranged to accept the authentication result of the first authentication unit if authentication by the second authentication unit does succeed, allow operation of the corresponding propulsion device if authentication by the first authentication unit does succeed, and to prohibit operation of the corresponding propulsion device if the authentication by the first authentication unit or the second authentication unit does not succeed.

3. A marine vessel theft deterrent apparatus for a marine vessel which includes a propulsion device, the theft deterrent apparatus comprising:

a keypad remote arranged to transmit a user authentication code;

a first computer including a first authentication unit, disposed apart from the propulsion device, and arranged to receive the user authentication code transmitted by the keypad remote, to execute an authentication process on the user authentication code, and to generate a unit authentication code;

a second computer including a second authentication unit arranged to receive the unit authentication code generated by the first authentication unit and to execute an authentication process on the unit authentication code;

a third computer including an operation control unit, disposed in the propulsion device, arranged to allow operation of the propulsion device if authentication by the second authentication unit does succeed, and to prohibit operation of the propulsion device if the authentication by the second authentication unit does not succeed;

a remote controller, connected to the propulsion device, arranged to be operated by a user to operate the propulsion device, the remote controller including the second authentication unit and being arranged to generate an authentication code; and a third authentication unit, disposed in the propulsion device, arranged to execute an authentication process on the authentication code generated by the remote controller; wherein the operation control unit is arranged to allow operation of the propulsion device if authentication by the third authentication unit does succeed and to prohibit operation of the propulsion device if the authentication by the third authentication unit does not succeed.

4. The marine vessel theft deterrent apparatus according to claim 3, wherein the operation control unit is arranged to accept the authentication result of the first authentication unit if authentications by the second and third authentication units do succeed, to allow operation of the propulsion device if authentication by the first authentication unit does succeed, and to prohibit operation of the propulsion device if the authentication by the first authentication unit does not succeed.

5. A marine vessel comprising:

a hull;

a plurality of propulsion devices installed on the hull;

a keypad remote arranged to transmit a user authentication code;

a first computer including a first authentication unit, disposed at a maneuvering compartment of the marine vessel apart from the propulsion device, and arranged to receive the user authentication code transmitted by the key remote, to execute an authentication process on the user authentication code, and to generate a unit authentication code;

a second computer including a second authentication unit and an operation control unit;

the second authentication unit, disposed in each of the plurality of propulsion devices, being arranged to receive the unit authentication code generated by the first authentication unit and to execute an authentication process on the unit authentication code; and the operation control unit, disposed in each of the plurality of propulsion devices, being arranged to allow operation of a corresponding propulsion device of the plurality of propulsion devices if authentication by the second authentication unit does succeed, and to prohibit operation of the corresponding propulsion device if the authentication by the second authentication unit does not succeed.

6. The marine vessel according to claim 5, wherein the operation control unit is arranged to accept the authentication result of the first authentication unit if authentication by the second authentication unit does succeed, allow operation of the corresponding propulsion device if authentication by the first authentication unit does succeed, and to prohibit operation of the corresponding propulsion device if the authentication by the first authentication unit or the second authentication unit does not succeed.

7. A marine vessel comprising:

a hull;

a propulsion device installed on the hull;

a keypad remote arranged to transmit a user authentication code;

a first computer including a first authentication unit, disposed apart from the propulsion device, and arranged to receive the user authentication code transmitted by the keypad remote, to execute an authentication process on the user authentication code, and to generate a unit authentication code;

a second computer including a second authentication unit arranged to receive the unit authentication code generated by the first authentication unit and to execute an authentication process on the unit authentication code; and a third computer including an operation control unit, disposed in the propulsion device, arranged to allow operation of the propulsion device if authentication by the second authentication unit does succeed, and to prohibit operation of the propulsion device if the authentication by the second authentication unit does not succeed;

a remote controller, connected to the propulsion device, arranged to be operated by a user to operate the propulsion device, the remote controller including the second authentication unit and being arranged to generate an authentication code; and a third authentication unit, disposed in the propulsion device, arranged to execute an authentication process on the authentication code generated by the remote controller; wherein the operation control unit is arranged to allow operation of the propulsion device if authentication by the third authentication unit does succeed and to prohibit operation of the propulsion device if the authentication by the third authentication unit does not succeed.

8. The marine vessel according to claim 7, wherein the operation control unit is arranged to accept the authentication result of the first authentication unit if authentications by the second and third authentication units do succeed, to allow operation of the propulsion device if authentication by the first authentication unit does succeed, and to prohibit operation of the propulsion device if the authentication by the first authentication unit does not succeed.

* * * * *